United States Patent [19]

Julian et al.

[11] 4,325,760

[45] Apr. 20, 1982

[54] METHOD OF MAKING A CABLE SPLICE

[75] Inventors: Victor J. Julian, Westchester; Kenneth A. Julian, Oak Brook, both of Ill.

[73] Assignee: Julian Electric Inc., Westmont, Ill.

[21] Appl. No.: 142,094

[22] Filed: Apr. 21, 1980

[51] Int. Cl.[3] ..... B21F 15/02

[52] U.S. Cl. ..... 156/49; 29/860; 29/862; 29/871; 29/872; 156/51; 228/136; 228/173 F

[58] Field of Search ..... 156/49, 91, 158, 51; 228/173 R, 173 A, 173 E, 173 F, 136; 29/872, 871, 860, 862

[56] References Cited

U.S. PATENT DOCUMENTS

| | | | |
|---|---|---|---|
| 2,463,231 | 3/1949 | Wyatt | 156/49 |
| 2,930,113 | 3/1960 | Greco | 29/872 |
| 3,100,330 | 8/1963 | Rice et al. | 228/136 |
| 3,449,818 | 6/1969 | Lowe et a. | 228/136 |
| 3,566,465 | 3/1971 | Weiner | 29/862 |
| 3,996,081 | 12/1976 | Nakata | 156/49 |

*Primary Examiner*—Jerome W. Massie
*Attorney, Agent, or Firm*—Edmond T. Patnaude

[57] ABSTRACT

A first cable is spliced to an intermediate portion of a second cable by inserting an end of the first cable and a stripped intermediate portion of the second into a metallic tube, then forging the tube and cable portions together, then bending the first cable at a desired angle relative to the second cable, then soldering the cables and tube together, and then molding a plastic cover over the tube and exposed conductive portions of the cables.

2 Claims, 6 Drawing Figures

METHOD OF MAKING A CABLE SPLICE

The present invention relates in general to cable splices and methods of splicing, and it relates more particularly to a novel splicing method and electric cable suitable for use in wiring harnesses and battery cables.

BACKGROUND OF THE INVENTION

Wiring harnesses used in electric power transmission systems commonly utilize a plurality of conductors or cables which are permanently connected together. This has ordinarily been accomplished by soldering the cables together or in some cases by tightly pressing or clamping the cables together and then wrapping the junction with an insulating tape or the like. Particularly where such connections are exposed and subject to rough handling and abuse, the prior art types of splices were unsatisfactory. Moreover, such methods of splicing were time consuming in that a considerable amount of labor was required. Therefore, it would be desirable to provide a splice which would not come apart under adverse conditions, which had an appearance of strength and durability, and which was adaptable to automated production line techniques.

SUMMARY OF THE INVENTION

Briefly, in accordance with one aspect of the invention there is provided a mechanically strong cable splice wherein one end of a first cable and an exposed conductive portion of a second cable are compressed together within a tubular metallic member and enclosed in an insulating cover molded directly over the spliced connection completely to enclose the conductive portions of the two cables.

In one embodiment of the invention after the metallic tube has been forged onto the cables, one cable is bent to a desired angle and the cables and tube are then soldered together before the cover is molded in place. Consequently, in the final product the solder joint and the cover cooperate to maintain the spliced portions of the cables in the desired angular relationship for subsequent use.

GENERAL DESCRIPTION OF THE DRAWING

The present invention will be better understood by a reading of the following detailed description taken in connection with the accompanying drawing wherein.

DETAILED DESCRIPTION OF THE INVENTION

Figure 1:
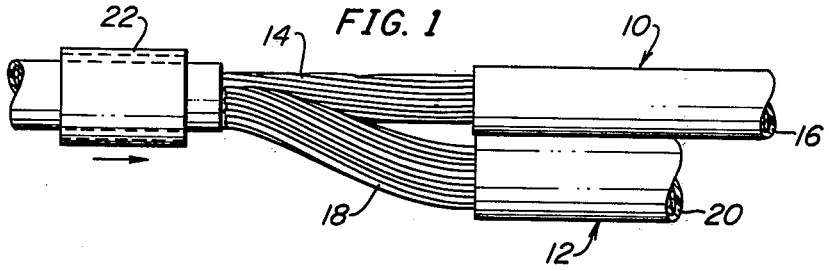
FIG. 1 is a view showing an initial step in splicing two cables together in accordance with the splicing method of the present invention.
Figure 2A:
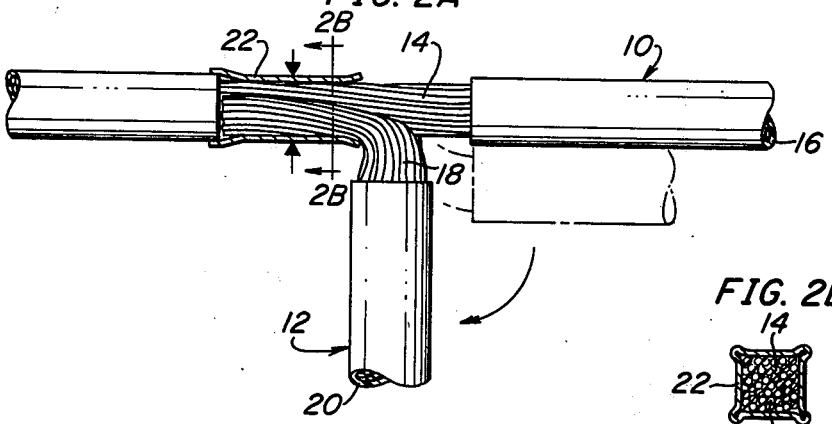
FIGS. 2A and 2B are views showing a subsequent step in the splicing method of the invention.
Figure 2B:
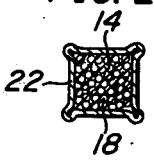
Figure 3:
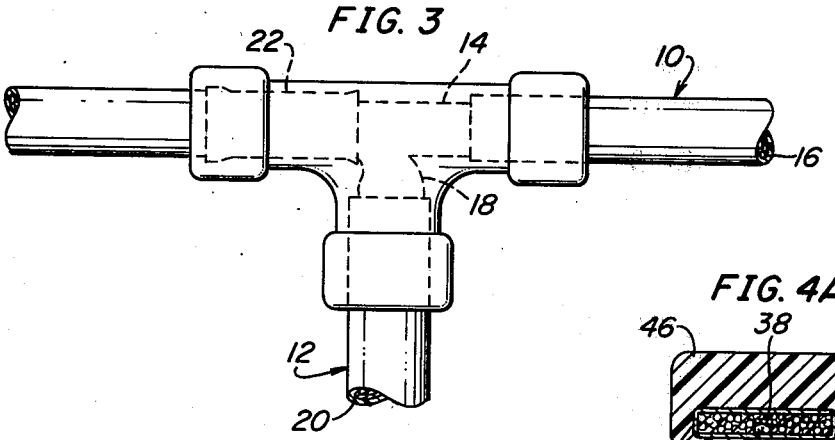
FIG. 3 is a view showing the complete splice.

Referring to FIGS. 1, 2 and 3, there is shown, in sequence, the stages in splicing a conductor 10 to another conductor 12 in accordance with the method of the present invention. The conductor 10 includes a stranded metal core 14 extending through a tubular layer of insulation 16, and the conductor 12 includes a stranded metal core 18 having a layer of insulation 20 thereover.

When carrying out the method of the present invention the insulation layers 16 and 20 are stripped from the portions of the wire cores 14 and 18 to be electrically connected together. The end portion of the wire 18 is then laid adjacent to the exposed portion of the cable 14 and a metal tube or sleeve 22 having an internal diameter substantially greater than the external diameter of the conductor 10 is then slid over the adjacent portions of the stranded wires 14 and 18. The tube 22 is then compressed or forged onto the wires to provide a good mechanical connection which prevents spurious disassembly of the cables. This step is best carried out in a forging press.

After completion of the forging step the conductor 12 is bent to a desired angle relative to that of the conductor 10. In the illustrated splice, this angle is 90° but the particular angle is not critical. The tube 22 and adjacent portions of the cables are then heated to a temperature exceeding the melting point of solder and melted solder is supplied thereto. The molten solder thus flows into the passages between the wire strands and between the tube and the strands. When solidified, the solder forms a good, low ohmic connection between the cables 14 and 18 and holds the conductor 12 at the desired angle relative to the conductor 10.

The interconnected portions of the two conductors are then placed in a mold, and a layer of a suitable insulation material such as polyvinyl chloride or rubber is molded directly over the cable juncture and the adjacent portions of the insulation layers 16 and 20. Preferably, the molten insulation melts the adjoining portions of the layers 16 and 20 to provide an integral bond therewith. The molding step is best carried out in an injection molding process.

Figure 4A:
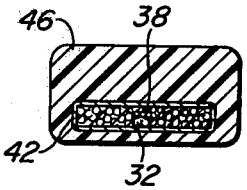
FIG. 4A is a cross-sectional view taken along the line 4A—4A in FIG. 4.
Figure 4:
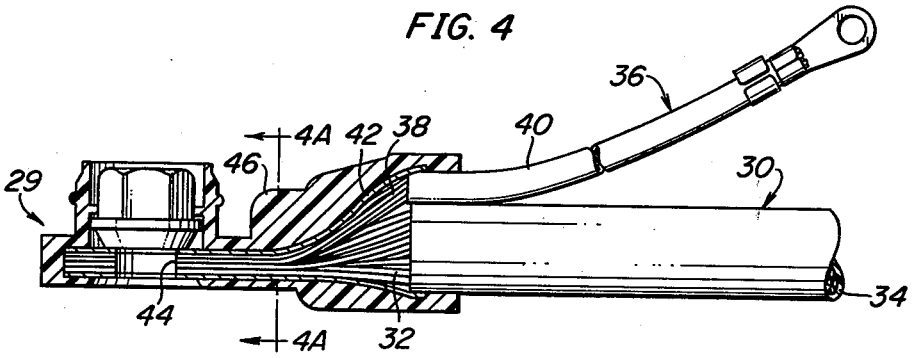
FIG. 4 is a partially sectioned view of a battery cable termination incorporating the novel splice of the present invention.

Referring to FIG. 4 there is shown an embodiment of the invention which is particularly suited for use in a battery cable termination 29 having a grounding pigtail conductor extending therefrom. This general type of termination and its method of manufacture is disclosed in U.S. Pat. No. 4,049,335. In this embodiment a conductor 30 has a central stranded wire core 32 covered by a layer of insulation 34. A pigtail lead 36 has a stranded wire core 38 covered by a layer of insulation 40.

When carrying out the method of this invention the cores 32 and 38 are stripped of the insulation layers and are compressed together within a metal tube or sleeve 42 which is forged onto the two cores. The tube 42 and enclosed strands of wire are flattened at the end and a hole 44 is punched therein to receive the threaded terminal stud of a battery. A cover of insulation material 46 is molded directly over the tube and enclosed wire strands and over the distal end portions of the insulation layers 34 and 40. Preferably, molten solder is flowed into the spaces between the strands and between the strands and the metal tube to provide both a low ohmic and good mechanical connection between the termination 29, the cable 30 and the pigtail 36.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A method of splicing a first metallic conductor to a second metallic conductor comprising the steps of providing a first conductor having an exposed stranded wire conductive portion, providing a second conductor having an exposed stranded wire conductive portion, inserting said conductive portions into a metallic tubular member, then forging said tubular member onto said conductive portions to mechanically and electrically interconnect said conductive portions, then bending one of said conductors at a predetermined angle relative to the other of said conductors at a location in proximity to said other of said conductors and said tubular member after said step of forging, then soldering said conductive portions together at the location where said one of said conductors was bent, and then molding a plastic cover over said tubular member and the soldered portions of said conductive portions of said conductors.

2. A method according to claim 1 wherein said conductors are covered by respective layers of insulation, and said cover is molded over the layers of insulation on both said first and second conductors.

* * * * *